US009382707B2

(12) United States Patent
Thiede et al.

(10) Patent No.: US 9,382,707 B2
(45) Date of Patent: Jul. 5, 2016

(54) ACOUSTIC SHELL FRAME AND SYSTEM

(71) Applicant: Staging Concepts Acquisitions, LLC, Minneapolis, MN (US)

(72) Inventors: Martin E. Thiede, Owatonna, MN (US); Jonathan Matthew Chase, White Bear Lake, MN (US); Christopher Jon Altringer, Circle Pines, MN (US)

(73) Assignee: Staging Concepts Acquisitions, LLC, Minneapolis, MN (US)

( * ) Notice: Subject to any disclaimer, the term of this patent is extended or adjusted under 35 U.S.C. 154(b) by 0 days.

(21) Appl. No.: 14/947,799

(22) Filed: Nov. 20, 2015

(65) Prior Publication Data

US 2016/0145860 A1 May 26, 2016

Related U.S. Application Data

(60) Provisional application No. 62/082,367, filed on Nov. 20, 2014.

(51) Int. Cl.
*E04B 1/82* (2006.01)

(52) U.S. Cl.
CPC ..... *E04B 1/8236* (2013.01); *E04B 2001/8263* (2013.01)

(58) Field of Classification Search
CPC ..... E04B 1/8236; E04B 2001/8263
USPC ..... 181/30, 287
See application file for complete search history.

(56) References Cited

U.S. PATENT DOCUMENTS

| | | | | | |
|---|---|---|---|---|---|
| 3,435,909 | A * | 4/1969 | Urch | E04B 1/8236 | 160/135 |
| 3,630,309 | A * | 12/1971 | Wenger | E04B 1/8236 | 160/135 |
| 4,278,145 | A * | 7/1981 | Eade | E04B 1/8236 | 160/135 |
| 5,115,608 | A * | 5/1992 | Abraham | E04B 2/7422 | 472/77 |
| 5,403,979 | A * | 4/1995 | Rogers | E04B 1/8236 | 181/287 |
| 5,524,691 | A * | 6/1996 | Jines | E04B 1/8236 | 16/276 |
| 5,530,211 | A | 6/1996 | Rogers et al. | | |
| 5,622,011 | A * | 4/1997 | Jines | E04B 1/8236 | 135/908 |
| 6,085,861 | A * | 7/2000 | Jines | E04B 1/8236 | 181/198 |
| 2008/0190690 | A1 * | 8/2008 | Waters | E04B 9/34 | 181/287 |

* cited by examiner

*Primary Examiner* — Jeremy Luks
(74) *Attorney, Agent, or Firm* — Hollingsworth Davis, LLC

(57) ABSTRACT

An acoustic shell system includes a frame comprising a first column, a second column, and a base. The first and second columns each comprise a circular portion with a channel along the length of the column where the circular portion is configured to attach to one or more panels. The circular portion is coupled to a noncircular portion opposite the channel having at least one channel along the length of the column and configured to attach to one or more components. The base comprises first and second arms coupled to opposing ends of a cross-support. Each of the arms is also coupled to one of the columns at about a ninety degree angle. The length of the cross-support is less than the distance between the first and second columns.

19 Claims, 12 Drawing Sheets

ACOUSTIC SHELL FRAME AND SYSTEM

FIELD OF THE INVENTION

The present invention is directed to staging systems for public and private use facilities. More particularly, the present invention relates to a staging acoustic shell system.

BACKGROUND

Performance areas, such as stages, are typically open spaces designed to accommodate a variety of configurations—background scenery, risers, seating, props, etc. As such, the sound quality is less than desirable, especially with respect to an audience. To improve sound quality for an audience, a shell is constructed on the stage, or in the performance area, as a curved, hard surface to reflect sound toward the audience. The shell itself is designed to absorb as little sound as possible. Shells, otherwise called acoustic shells, are utilized in a variety of performance applications including any application that benefits from passive sound amplification. Acoustic shells can be removable such as by rolling panels away, flying them into a flyspace, or both.

SUMMARY

Embodiments of the present invention provide an alternative to complex and time consuming installations of acoustic shell systems. The described systems can be erected with the use of minimal tools and use minimal components. The systems provide for flexible adjustment of modular components and are readily reconfigurable and customizable.

One embodiment is directed to a system comprising a first column, a second column, and a base. The first column comprises a first circular portion with a channel along the length of the first column, and the first circular portion is configured to attach to one or more panels. A first noncircular portion is coupled to the first circular portion opposite the channel and has at least one channel along the length of the first column. The second column, similar to the first, comprises a second circular portion with a channel along the length of the second column, and the second circular portion is configured to attach to one or more panels. A second noncircular portion is coupled to the second circular portion opposite the channel of the second circular portion and has at least one channel along the length of the second column. The base comprises first and second arms having first and second ends, wherein the first end of each arm is coupled to opposing ends of a cross-support. The second end of the first arm is coupled to the first column at about a ninety degree angle, and the second end of the second arm is coupled to the second column at about a ninety degree angle. The length of the cross-support is less than the distance between the first and second columns.

Another embodiment is directed to a system comprising a first column, a second column, a base, at least one central panel, and at least one wing panel. The first column comprises a first circular portion with a channel along the length of the first column, and the first circular portion is configured to attach to one or more panels. A first noncircular portion is coupled to the first circular portion opposite the channel and has at least one channel along the length of the first column. Similarly, the second column comprises a second circular portion with a channel along the length of the second column, and the second circular portion is configured to attach to one or more panels. A second noncircular portion is coupled to the second circular portion opposite the channel of the second circular portion and has at least one channel along the length of the second column. The base comprises first and second arms having first and second ends, wherein the first end of each arm is coupled to opposing ends of a cross-support. The second end of the first arm is coupled to the first column at about a ninety degree angle, and the second end of the second arm is coupled to the second column at about a ninety degree angle. The length of the cross-support is less than the distance between the first and second columns.

The at least one central panel has opposing front and back surfaces and opposing first and second sides. A first rotatable member comprises a partial collar and a tab and is sleeved over the first column with the tab directed toward the second column. A second rotatable member comprises a partial collar and a tab and is sleeved over the second column with the tab directed toward the first column. The tab of the first rotatable member is attached to the back surface on the first side of the at least one central panel, and the tab of the second rotatable member is attached to the back surface on the second side of the at least one central panel. The first rotatable member is locked in position via the channel of the first circular portion, and the second rotatable member is locked in position via the channel of the second circular portion.

The at least one wing panel has opposing front and back surfaces and opposing first and second sides. A third and a fourth rotatable member are sleeved onto the first column where the third rotatable member is below the first rotatable member and the fourth rotatable member is above the first rotatable member. The tabs of the third and fourth rotatable members are positioned directed away from the second column and are attached to the back surface of the at least one wing panel on the first side, and the at least one wing panel is configured to rotate about the first circular column.

A further embodiment is directed to a method for assembling an acoustic shell tower. The method comprises providing a tower frame comprising a wheeled base and first and second columns attached to respective arms of the wheeled base at approximately ninety degree angles, where each column comprises a circular portion with a channel along the length of the column and a noncircular portion coupled to the first circular portion opposite the channel and has at least one channel along the length of the column. First, second, and third rotatable members are sleeved over the circular portion of the first column, wherein each rotatable member comprises a partial collar and a tab and the tabs of the first and third members are positioned in a first direction away from the second column, and the tab of the second rotatable member is positioned in a second, opposing direction toward the second column. Fourth, fifth, and sixth rotatable members are sleeved over the circular portion of the second column, wherein each rotatable member comprises a partial collar and a tab and the tabs of the fourth and sixth members are positioned in the second direction away from the first column, and the tab of the fifth rotatable member is positioned in the first direction toward the first column. A back surface of a central panel having a top and a bottom, the bottom being proximate a support surface is attached to the tabs of the second and fifth rotatable members. The second and fifth rotatable members are secured to the respective first and second columns via respective channels along the circular portions of the first and second columns. A back surface of a first wing panel is attached to the tabs of the first and third rotatable members, and the first wing panel is configured to rotate about the first column. A back surface of a second wing panel is attached to the tabs of the fourth and sixth rotatable members, and the second wing panel is configured to rotate about the second column.

These and various other advantages and features of novelty are pointed out with particularity in the claims annexed hereto and form a part hereof. However, for a better understanding of the invention and its advantages, reference should be made to the drawings which form a further part hereof, and to accompanying descriptive matter, in which there are illustrated and described representative examples of apparatuses, methods, and systems in accordance with the invention.

BRIEF DESCRIPTION OF THE DRAWINGS

The invention is described in connection with embodiments illustrated in the following figures.

DETAILED DESCRIPTION

In the following description of various exemplary embodiments, reference is made to the accompanying drawings that form a part hereof, and in which is shown by way of illustration various embodiments in which the invention may be practiced. It is to be understood that other embodiments may be utilized, as structural and operational changes may be made without departing from the scope of the present invention.

In accordance with embodiments of the invention, a modular acoustic shell system includes tower assemblies of support columns and acoustic panels. The columns are configured to support a variety of acoustic panels in various shapes and sizes. The panels are arranged, and secured, to form an acoustic shell. For example, a column arrangement can include two parallel, vertical columns supporting panels in at least three positions, a center panel, and at least one to the left and the right of the center panel. A series of these arrangements can be positioned to form three walls of an acoustic shell. The shell can also optionally include a ceiling with further acoustic panels and/or other components such as lighting. The support columns are configured to be erected with minimal tools and to be manually movable.

Figure 1:
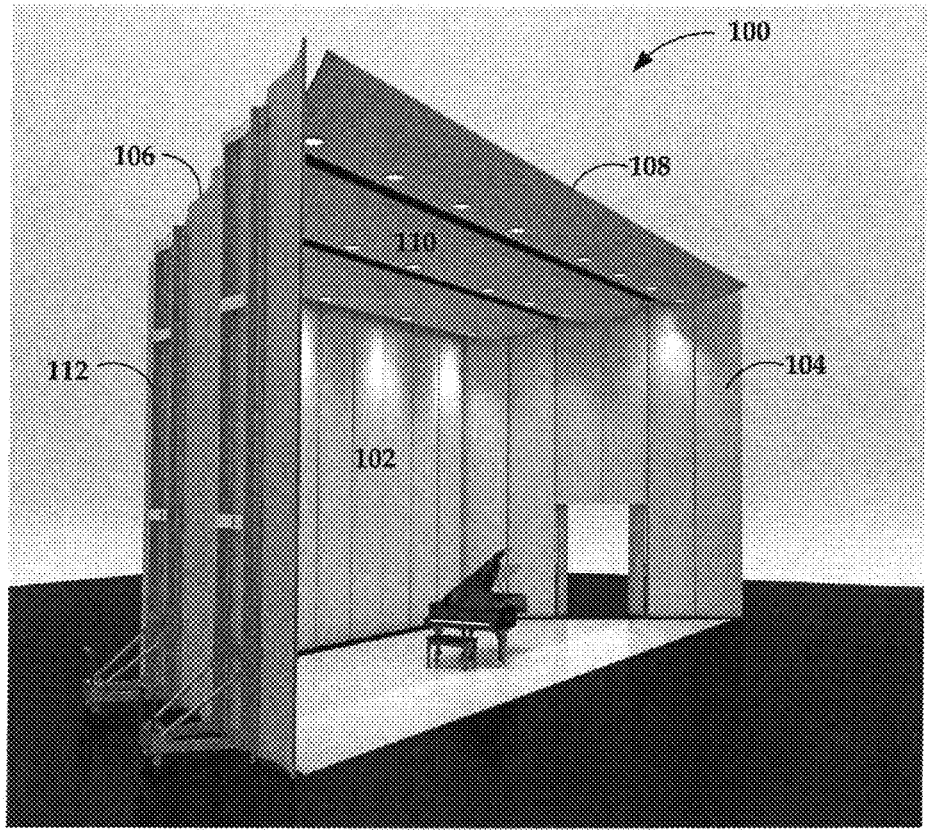
FIG. 1 is a perspective view of an acoustic shell system according to example embodiments.
Figure 2:
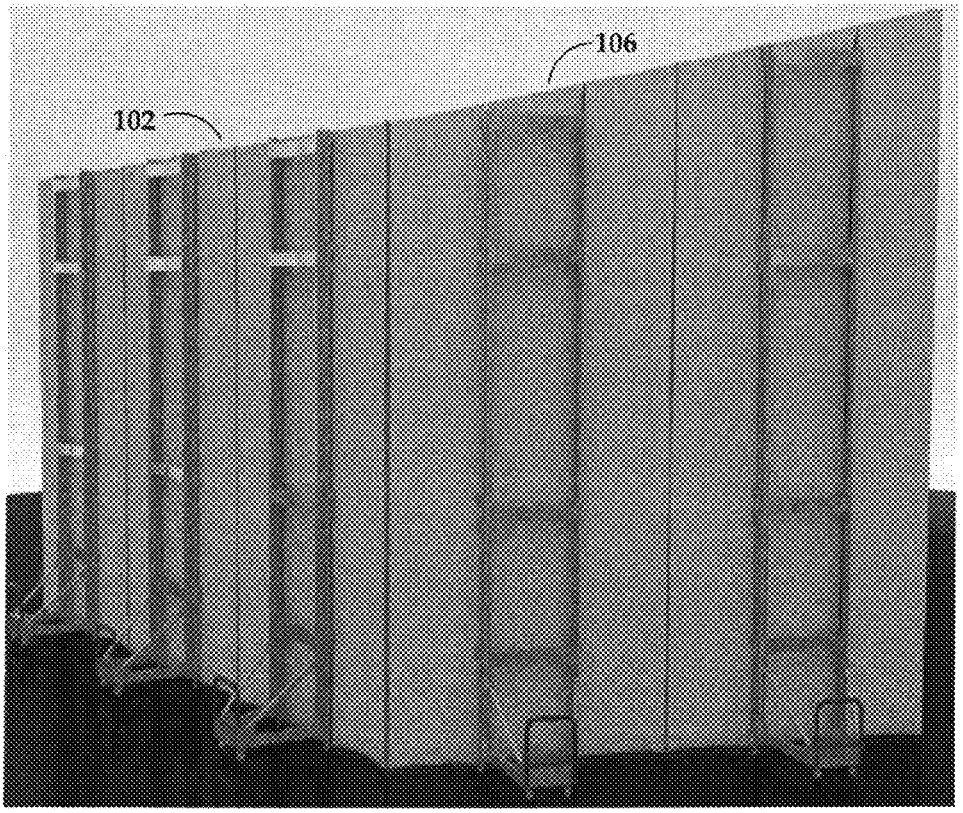
FIG. 2 is rear perspective view of an acoustic shell system according to example embodiments.

Turning to FIG. 1, an assembled acoustic shell 100, according to example embodiments is shown. From the audience's viewpoint, the acoustic shell 100 includes a back wall 102, a right sidewall 104, a left sidewall 106, and a ceiling 108. The ceiling 108 comprises a plurality of ceiling panel assemblies 110 that are discussed further below. The walls of the acoustic shell 100 are each comprised of a plurality of tower assemblies, where each tower assembly comprises a frame with acoustic panels attached thereto. FIG. 2 shows a rear perspective view of acoustic shell 100. Back wall 102 is comprised of three tower assemblies, and left sidewall 106 (similar to right sidewall 104) is comprised of two tower assemblies. As shown, the tower assemblies can vary in height. Also, the panels of the tower assemblies can extend beyond the height of the frame. The modular nature of the acoustic shell 100 facilitates construction of a variety of shapes and sizes. Adding tower assemblies can create a larger shell 100, and a smaller shell 100 can be constructed with fewer tower assemblies when less space is available or needed.

Figure 3:
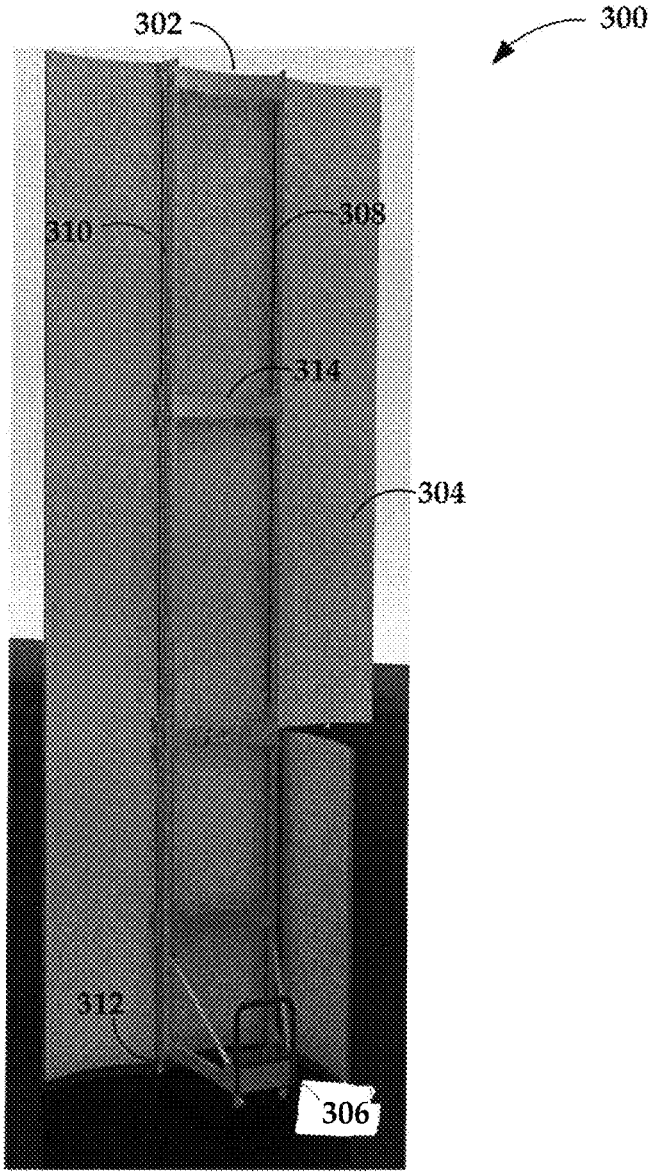
FIG. 3 is a rear view of an acoustic shell tower assembly according to example embodiments.

An example tower assembly 300 is shown in FIG. 3. As set forth above, the tower assembly 300 comprises a frame 302 and one or more panels 304. The frame 302 comprises a base 306 and two columns 308, 310. The base 306 is a generally rearward extending wedge or tripod-shaped frame horizontal to a support surface such as a stage floor. The open base frame includes two arms extending from a cross-support. The cross-support provides a counterweight for the columns 308, 310 and panels 304 of the tower assembly 300. The cross-support can include a handle and wheels for manual transport and steering. Both columns 308, 310 couple to respective arms of the base 306 at about a ninety degree angle. One or more portions of the columns 308, 310 are at least partially hollow, or open, such that footing structures 312 are attached to the ends of the columns proximate the connection to the base 306. The footing structures 312 are inserted in the bottom of the respective columns and are height adjustable. The footing structures 312 provide a stable support for the tower assembly 300 and include receptor positions for manually moving the tower assembly 300. The frame 302 can also include horizontal supports 314 between the columns 308, 310 for additional stability. The frame can be constructed from a variety of materials, such as metals, and including aluminum. For example, the frame 302 can be constructed of aluminum and the columns can be extruded aluminum. Reducing the weight of the frame provides easier mobility as well as a reduction in point loads on a stage floor.

The tower assembly 300 includes one or more acoustic panels 304. The panels 304 are configured to improve acoustics in the performance area. Therefore, they are shaped to direct sound toward the shell opening, i.e., toward an audience. As such, the panels 304 may be curved, as shown. However, the radius of curvature can vary depending on the size and/or use of the panels 304. The panels 304 are constructed of materials to reduce sound absorption and further improve the shell acoustics. They are designed to be rigid, light weight, and sound reflective including a honeycomb cell core secured within a hardboard casing. The casing can be any variety of materials such as wood or plastic laminates and may be any variety of colors and finishes including being painted or stained and finished. The panels can also include an aluminum edging for attaching brackets, locking mechanisms, and providing a consistent edge when vertically aligned with other panels. FIG. 3 shows a tower assembly 300 with nine panels 304. Three of the panels are fixed in place between the two columns 308, 310 and six of the panels 304 (three on the right side and three on the left side) are rotatably attached to the tower assembly 300. Attachment of the panels 304 to the frame 302 is facilitated through the configuration of the columns 308, 310 and a rotatable member.

Figure 4:
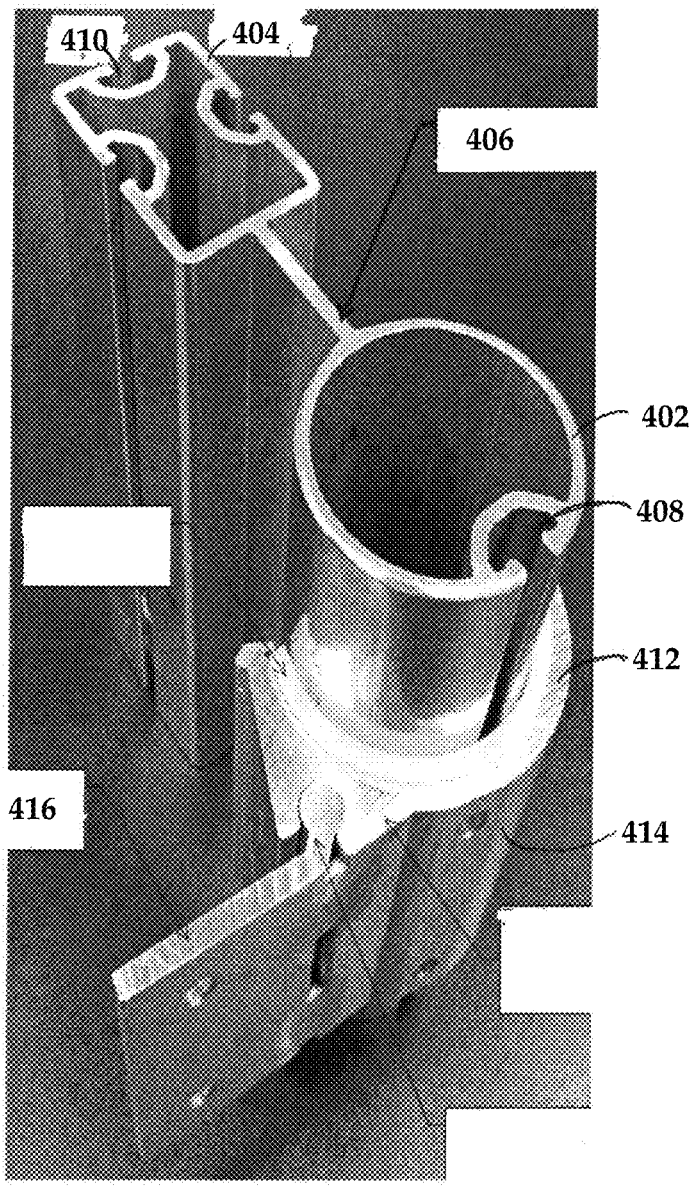
FIG. 4 is an isometric view including a cross-section of a column according to example embodiments.

FIG. 4 shows a perspective cross-section of one of the columns 308. The columns 308 and 310 are identical and substantially parallel to each other. Thus, a description herein of one column 308 also applies to column 310. The column 308 comprises a first, circular portion 402 and a second non-circular portion 404. The two portions are coupled together, e.g., via a webbing 406. The circular portion 402 includes a channel 408 that extends along the length of the column 308. The channel 408 is located opposite the webbing 406. The noncircular portion 404 can comprise any number of cross-sectional shapes and includes at least one channel 410 extending along the length of the column 308. For example, the noncircular portion 404 illustrated has a rectangular shape having a channel on three of the four sides along the length of the column 308, where the fourth side comprises the webbing 406. A frame 302 could include two columns having differently shaped noncircular portions 404. The noncircular portion 404 is configured to attach various components, along the length of a column. The one or more channels 410 can receive bolts or other fastening hardware for integral locking of accessory components. Because the channels run the length of the column, components may be attached at any height on the column. Such components can include cross-supports 314 and additional supports between the cross-support on the base 306 and the columns 308, 310. The channels 410 can also facilitate attachment of components, for example, without drilling. The columns are attached to the base 306 such that the circular portion 402 is positioned forward, away from the base, and the noncircular portion 404 is positioned backward, toward the base.

To attach panels 304 to the columns 308, 310 a rotatable member 412 is coupled to the circular portion 404 of each of the columns. The rotatable member 412 includes a partial collar 414 and a tab 416. The tab 416 includes attachment points, e.g., holes, for securing a panel 304 to the tab 416. The tab 416 includes a rotating joint to allow the attached panel to be positioned at a variety of radii. The tab 416 is configured to attach to any variety of sized panels including five, ten, and twenty foot radius curved panels as well as customized panels. The tab can also be welded to the partial collar 414. While the rotatable member 412 can be sleeved onto the circular portion 404 of a column 308, the partial collar 414 can be separated from the circular portion 404 by a nylon or ultra-high molecular weight polyethylene self-lubricating bushing. The rotatable member 412 is used to affix both central, fixed panels and rotatable, wing panels to the tower assembly 300. The type of panel determines the position of the tab 416. If a central, fixed panel is being attached, the rotatable member 414 is positioned on the circular portion 404 with the tab 416 directionally pointing toward the opposing column. If a side, wing panel is being attached, the rotatable member 414 is positioned on the circular portion 404 with the tab 416 directionally pointing away from both of the columns. The rotatable member 412 can be symmetrical such that either open end of the partial collar 414 can be sleeved onto the circular portion 404 with the only difference being the direction in which the tab 416 points. One or more rotatable members 412 are positioned along the circular portion 404 of a column 308, 310 at various heights along the length of the column 308, 310. The panels can be attached to the tabs 416 with a variety of fasteners such as bolts, screws, nails, etc.

Attaching a central, fixed panel to the tower assembly 300 involves at least two rotatable members 412—one on each column 308, 310. While panels 304 can be attached to a rotatable member 412 at any position along an edge of the panel, a rotatable member 412 is typically attached near the top and bottom and/or in the middle of the back surface of a panel 304. Affixing a rotatable member 412 near the middle of a central panel located at the bottom of a tower assembly 300 facilitates removal of a bottom portion of the central panel. The partial collar 414 of a rotatable member 412 is sleeved over the circular portion 404 of a column 308 with the tab 416 positioned inward, or toward the other column 310. On the opposing column 310, a rotatable member 412 is positioned with the tab 416 positioned inward, or toward the first column 308. The rotatable members 412 are secured to the circular portion 404 by affixing, e.g., bolting, the rotatable members 412 in place. For example, the rotatable members 412 can include one or more access holes on the partial collar 414. Bolts can be inserted through the access holes and into the channel 408 to prevent the rotatable members 412 attached to a central panel from rotating.

Attaching a rotatable, side, wing panel on either column 308, 310 also involves at least two rotatable members 412. Here, the two rotatable members 412 are positioned surrounding a rotatable member 412 attached to a central panel. Both rotatable members 412 are positioned with their tabs 416 facing outward, or away from both columns 308, 310. The two rotatable members 412 of the wing panel being adjacent, sandwiching, the rotatable member 412 of the central panel provides for rigid attachment of the wing panel and rotation of the wing panel about the circular portion 404. The partial collar 414 in conjunction with the webbing 406 provides a stopping mechanism to limit the amount of rotation toward the central panel. For example, the circumference of the partial collar 414 may be about two-thirds of a circle, or about one-third of the collar is absent. The partial collar 414 also allows the wing panels to rotate away from the central panel and toward the base 306 to a folded position. The folded position can be used for storing the tower assemblies 300. In addition, the wing panels can be locked into an open position with a locking mechanism at the back surface of the wing panel. The locking mechanism can attach to a channel 410 of the noncircular portion 404.

As described above, a plurality of panels 304 can be affixed to a frame 302 to form a tower assembly. A plurality of central panels can be affixed in vertical alignment between the two columns 308, 310. Also, a plurality of wing panels can be affixed in vertical alignment on one or both sides of the frame 302. For example in FIG. 3, three central panels are shown with three wing panels on the left side (attached to column 308) and three wing panels on the right side (attached to column 310).

It is understood that the modular acoustic shell system of the present invention may be used with various accessories and devices. For example, panels in a variety of sizes and shapes, openings such as doors, signage, flooring, ceiling/roofing configurations, and other accessories may be suitably arranged at any desirable location on the columnar frame system. These accessories may be attached to the columns, panels, ceiling panels, or to other components attached to the shell system.

Figure 5:
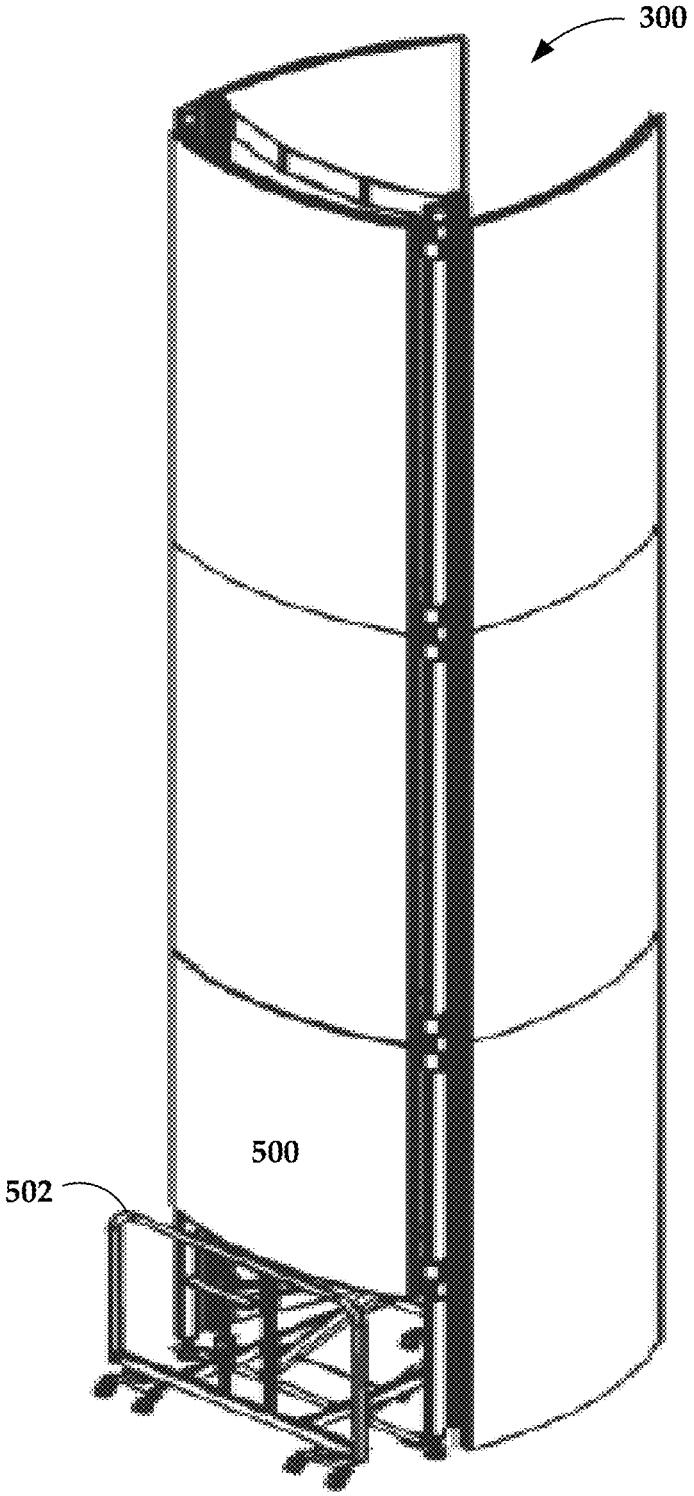
FIG. 5 is a perspective view of an acoustic shell tower assembly engaged with a wheeled transport according to example embodiments.

A feature of an acoustic shell is a lack of permanence. Thus, the tower assemblies need to be moved and stored when not in use. An example embodiment of a transport mechanism for tower assemblies 300 is shown in FIG. 5. A tower assembly 300 is shown with both sets of wing panels, left and right sides, in a folded position. The bottom central panel 500 has a bottom portion removed, which exposes the base 306 and footing structures 312 behind the panels. A wheeled transport 502 is inserted in the opening left by the absent portion of the central panel. The wheeled transport is configured to engage and lift the columns 308, 310 of the tower assembly 300 for manual maneuvering. For example, the wheeled transport engages the footing structures 312 and base 306 such that once the footing structures 312 are elevated the wheeled transport 502 and tower assembly 300 move as one unit. The unit can be pushed or pulled from either the front or back using a handle on the wheeled transport 502, or a handle attached to the base 306.

Figure 6:
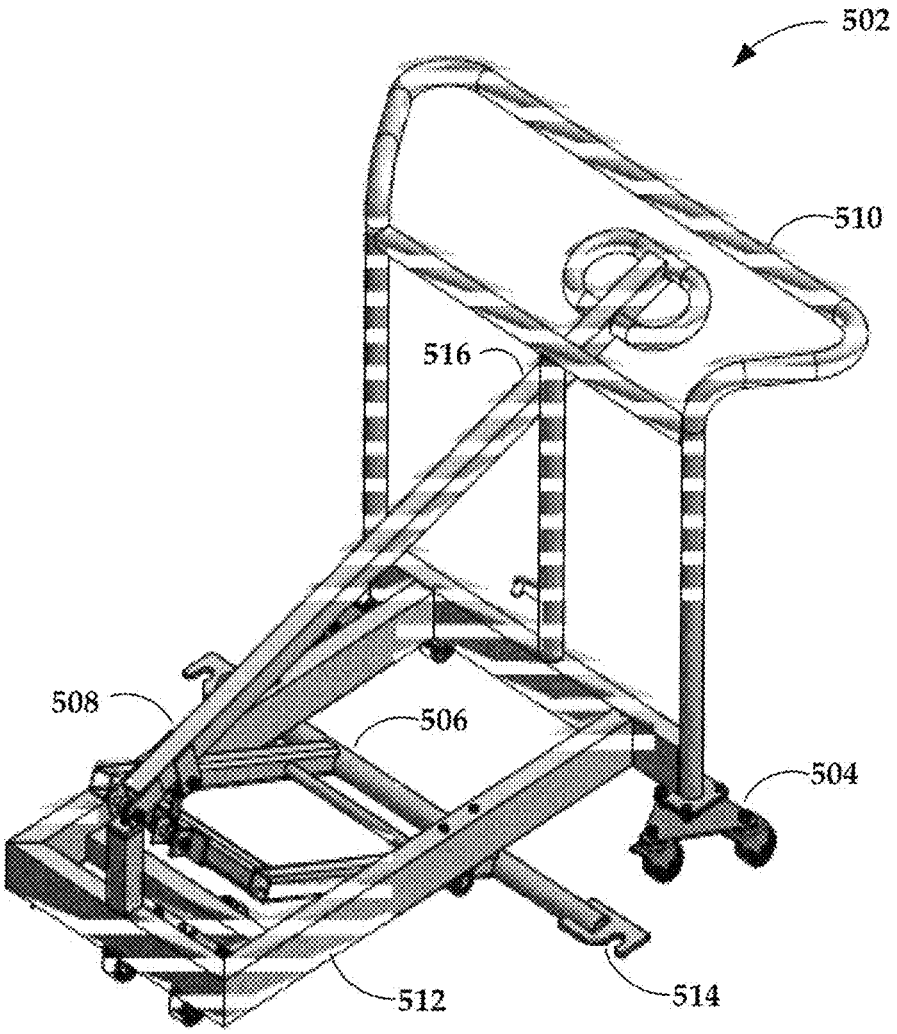
FIG. 6 is a perspective view of a wheeled transport according to example embodiments.

FIG. 6 provides an example embodiment of a wheeled transport 502. The wheeled transport 502 uses three tri-casters 504 for ease of movement and positioning, as well as to reduce point loads on the support surface such as a stage floor. The shape of the base 512 of the wheeled transport corresponds to the shape of the base 306 of the tower assembly 300 to provide a nesting relationship between the wheeled transport 502 and the tower assembly 300 when they are engaged as shown in FIG. 5. An engagement bar 506 includes two hooks 514, one at each end of the bar 506. The hooks 514 engage, and secure to, a position on the footing structures 312. Regardless of the height to which the footing structures are adjusted, the engagement position remains the same. Once the hooks 514 are securely engaged, a dual-lever lifting mechanism 508 that is connected to the engagement bar 506 is activated. The lifting mechanism 508 includes a top lever 516 that is pressed down to lift the columns 308, 310 off the stage floor. For example, the top lever 516 may rest on a top hook when not activated. To activate the lifting mechanism 508, the top level 516 can be slid out and off the top hook, pressed down, and slid under a bottom hook to secure the top lever 516 in an activated (columns lifted) position. The top lever 516 can include a handle for ease of use. With the columns 308, 310 secured and elevated, the wheeled transport 502 and tower assembly 300 (including the wheeled based 306) can be moved manually as one unit to a storage location. The wheeled transport 502 is operated manually without hydraulics, air bearings, or a power source required. Once a tower assembly 300 has been moved to a storage location, the process can be repeated for a plurality of other tower assemblies 300.

Figure 7:
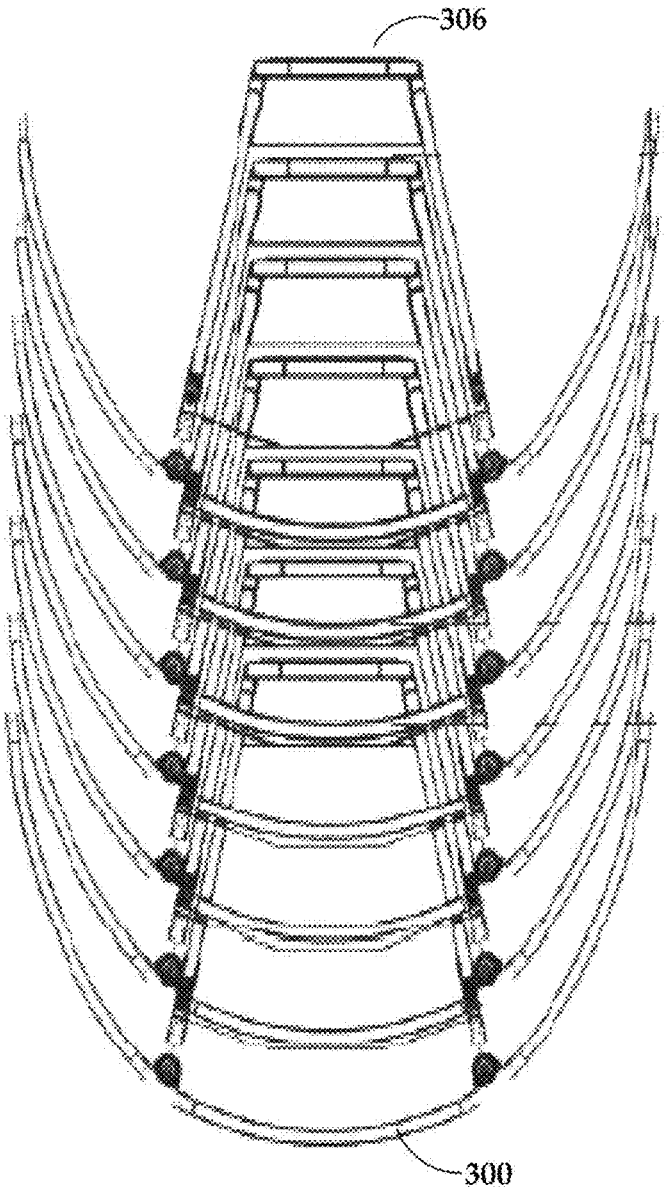
FIG. 7 is top view of a plurality of stored acoustic shell tower assemblies according to example embodiments.

FIG. 7 shows an overhead view of a plurality of tower assemblies 300 stored together. The seven tower assemblies 300 have their respective bases 306 inserted in a nesting relationship. By removing the bottom portion of a bottom central panel 500 on each tower assembly 300, both the wheeled transport 502 can be engaged and the tower assemblies 300 can be nested. The respective wing panels are rotated, e.g., folded, rearward toward the bases such that the panels are also in a nested relationship. This storage configuration can both save space during storage and keep the tower assemblies 300 at the ready for easy access for construction of another acoustic shell.

Figure 8:
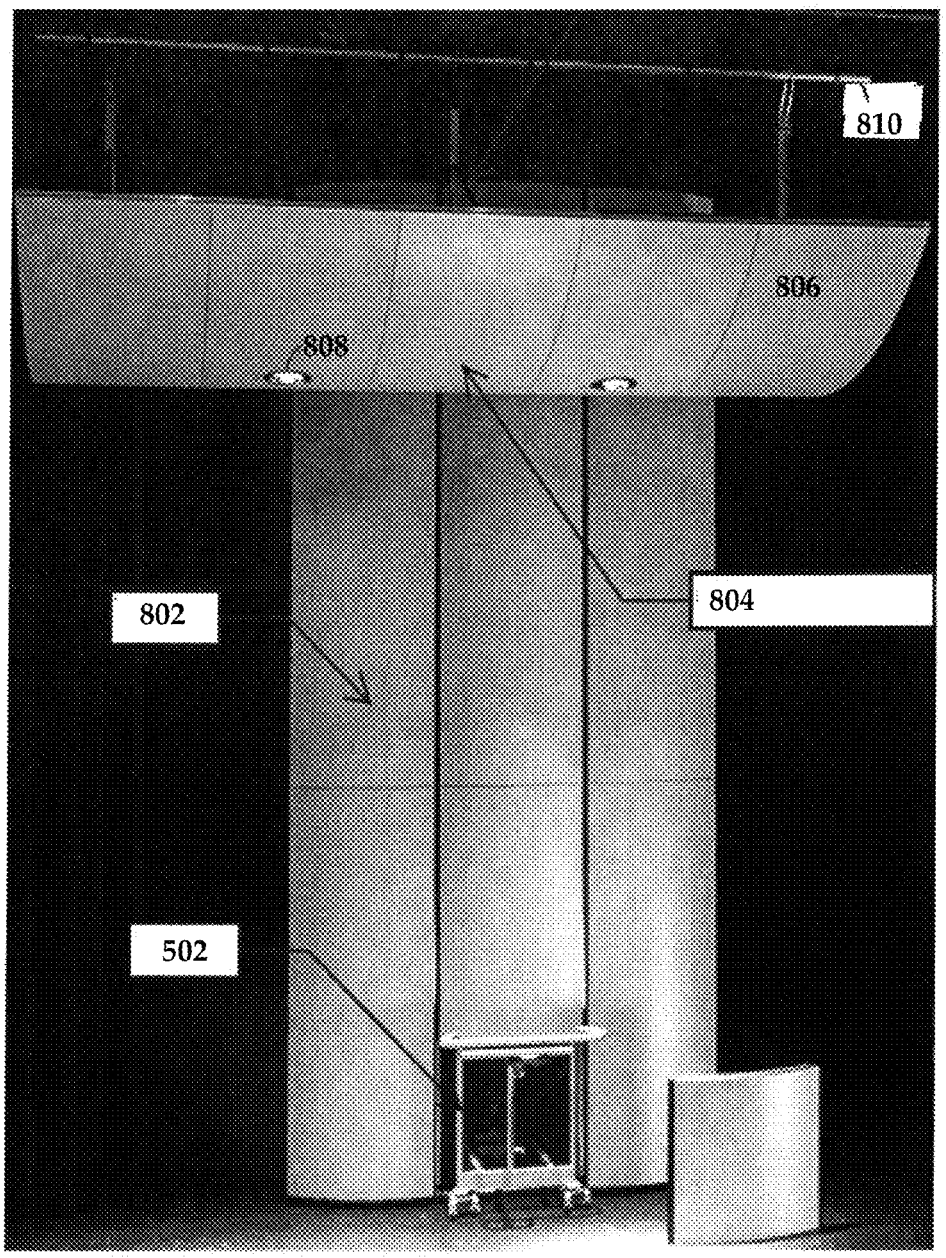
FIG. 8 is a front view of an acoustic shell tower assembly and ceiling panel assembly according to example embodiments.

Turning to FIG. 8, an acoustic shell tower assembly 802 is illustrated in combination with a ceiling panel assembly 804. The ceiling panel assembly 804 serves as a ceiling for an acoustic shell by further containing or directing sound toward an audience. As shown, the shell tower 802 can extend above, beyond the height of the ceiling panel assembly 804, and the tower 802 and the ceiling panel assembly 804 are not necessarily connected or in contact with each other, although they can be. The ceiling panel assembly 804 can include multiple panels 806. For example, the assembly 804 in FIG. 8 shows five panels. The ceiling panels 806 can be the same as, or different from, the panels on the shell tower 802 and are configured to improve acoustics in the performance area. Therefore, they are shaped to direct sound toward the shell opening, i.e., toward an audience. As such, the panels 806 may be curved, as shown. For example, the panels 806 are constructed of materials to reduce sound absorption and further improve the shell acoustics. They are designed to be rigid, light weight, and sound reflective including a honeycomb cell core secured within a hardboard casing. The casing can be any variety of materials such as wood or plastic laminates and may be any variety of colors and finishes. Varying components 808, such as lights, can be inserted in the ceiling panels 806. The ceiling panel assembly 804 is supported by being suspended from a batten 810 positioned on/near a ceiling or in a fly space of a stage. The suspension mechanism is now described in further detail.

Figure 9:
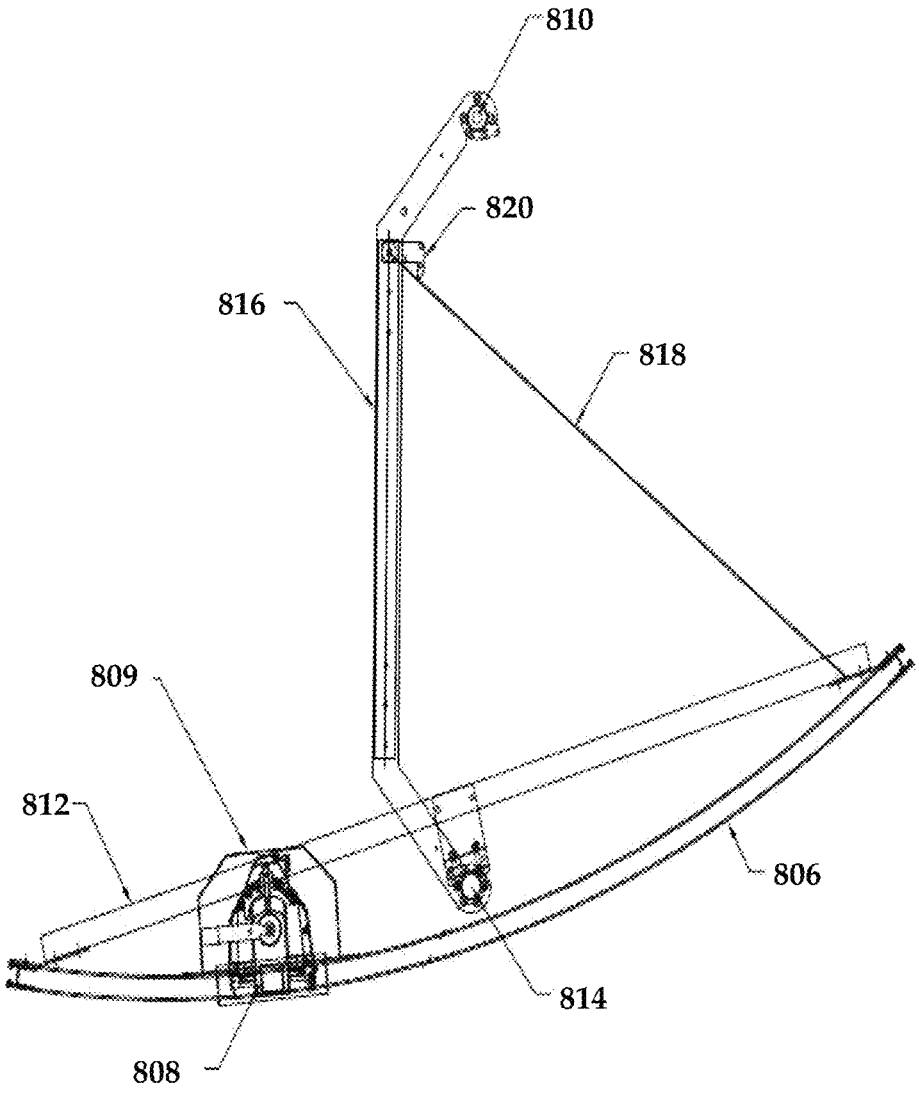
FIG. 9 is a side view of a ceiling panel assembly according to example embodiments.

FIG. 9 shows a side view of the ceiling panel assembly 804. The ceiling panel 806 is attached to one or more support beams, or bows 812. A spine 814 connects the one or more bows 812 forming a frame to which the ceiling panel 806 is attached. The curvature of the ceiling panel 806 extends outward from the one or more bows 812 to accommodate the positioning of the spine 814. The curvature can also accommodate various components 808 or accessories built into the ceiling panel 806. For example, a component 808 such as a light fixture may include a housing 809 that extends from, and may be supported by, the rear surface of the ceiling panel 806. Lighting fixtures can be integrated into the ceiling panels 806 and plugged into connector strips by concealing wiring behind the ceiling panels 806 and along support arms 816. Other example components 808 that may be incorporated into the ceiling panels 806 may include speakers and spray devices for water or confetti.

The spine 814 is hingeably attached to one or more support arms 816 which connect the ceiling panel 806 to an overhead rigging system including batten 810. The spine 814 is attached with a bearing bracket so that the ceiling panel 806 and frame is rotatable with respect to the support arms 816. An adjustable strap 818 connects one edge of the ceiling panel 806, e.g., the edge closest to the audience, at one end of a bow 812, with a latch 820 on the arm 816 at a position near the rigging and opposite the end of the arm connected to the spine 814. For stability, each arm is shown as including an adjustable strap 818; however, fewer than all arms could include such a strap. The adjustable strap 818 allows the ceiling panel 806 to be positioned, e.g., lowered, at any angle of rotation with respect to a vertical storage position based on the length of the adjustable strap 818. The adjustable strap 818 and/or the latch 820 may also have a mechanism for lowering the panel edge at predetermined increments or for accurately setting the angle of position for the ceiling panel 806. For example, the adjustable strap 818 can be adjusted in five degree increments. The support arms 816 are connected to a batten 810 or other overhead stage rigging. The overhead rigging may be stationary or adjustable (vertically or horizontally).

Figure 10A:
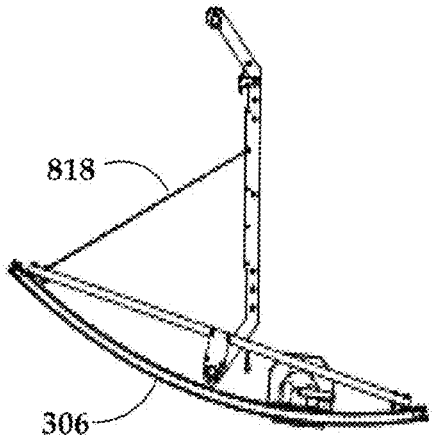
FIG. 10A is a side view of a ceiling panel assembly in a use position according to example embodiments.
Figure 10B:
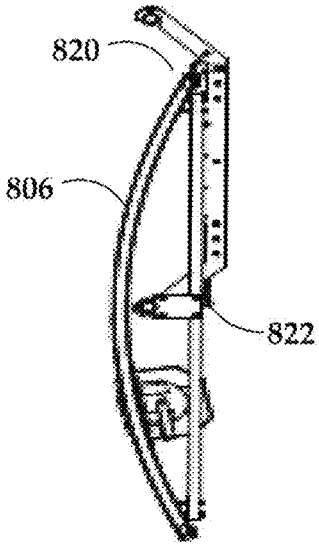
FIG. 10B is a side view of a ceiling panel assembly in a stored position according to example embodiments.

Rotation of the spine 814 enables the ceiling panel 806 to rotate between "storage" and "play" positions. FIGS. 10A and 10B illustrate a use, or "play," position and a storage position, respectively, for the ceiling panel assembly 804. In FIG. 10A, the ceiling panel assembly 804 is shown extended at an angle, other than perpendicular, to the ground, or stage floor. The adjustable strap 818 is extended and taut to secure the angled position of the ceiling panel 806. As discussed above, the adjustable strap 818 can be adjusted to varying lengths to alter the angled position of the ceiling panel 806, e.g., to maximize acoustics for the acoustic shell positioned on the stage. While the component 808 is shown located in the bottom, lower portion of the ceiling panel 806, the component 808 could be located at any position on the ceiling panel 806 with the requisite support for the weight and location of the component 808. In FIG. 10B, the ceiling panel 806 is shown in a vertical, locked, storage position. The storage position moves the ceiling panel 806 up into a fly space so as to be unseen from an audience when not in use. In the storage position, the adjustable strap 818 is slack, or shortened, to hold the ceiling panel 806 in a vertical position. In addition, the ceiling panel 806 can be locked into the vertical, storage position with latch 820. Latch 820 is located on the arm 816 and couples with the bracket that secures the adjustable strap 818 to the ceiling panel edge. Fewer than each of the arms 816 may include a latch 820. For example, the arms 816 at each end of a panel assembly 804 might include latches. The latch 820 is released using a storage release strap 822 to facilitate rotation of the ceiling panel 806 from the storage position to a use position. As few as two people can rotate the ceiling panel assemblies 804 from a use position to a storage position.

Figure 11:
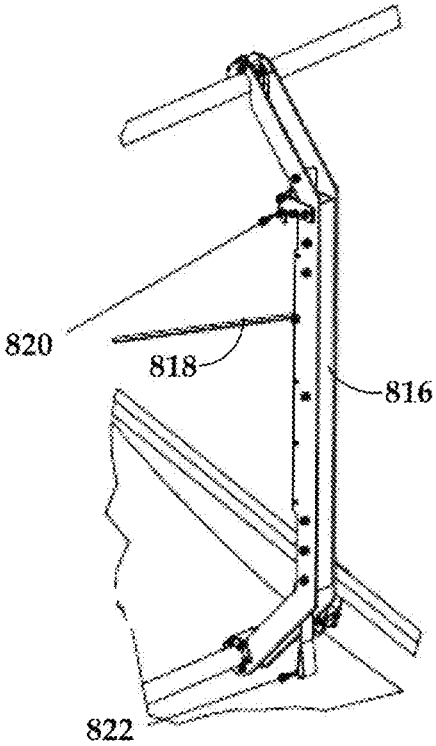
FIG. 11 is a perspective view of a ceiling panel arm according to example embodiments.

FIG. 11 provides a detailed view of an arm 816. The latch 820 is attached proximate a first end of the arm 816 positioned near the rigging. For example, the latch can be located at a point where the arm 816 shifts from a straight configuration to an angled configuration to the first end. The first end of the arm 816 terminates in a hook for hanging the arm on a batten 810. The hook can include a U-bolt and bracket for securing the arm 816 to the batten 810 or other rigging. At the opposing end of the straight portion of arm 816, the arm can correspondingly be angled to attach to the spine 814. The angling of the arm 816 in connection with the curvature of the ceiling panel 806 provides for a compact storage position as well as for space for various components 808, including wiring and housings associated with such components. As shown, the storage release strap 822 hangs parallel to the straight portion of the arm 816. The loop of the storage release strap 822 is pulled down to release latch 820 and allow the ceiling panel 806 to rotate into a use position.

Figure 12:
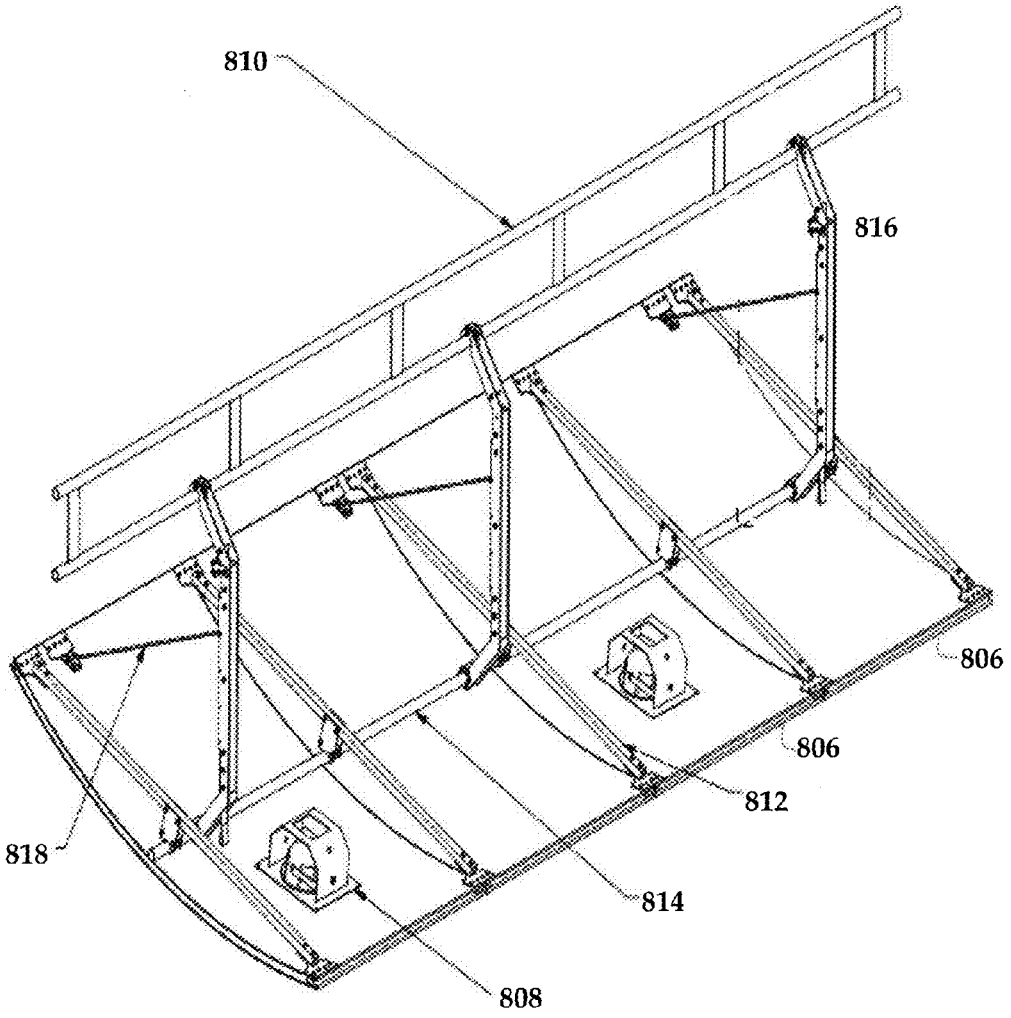
FIG. 12 is a perspective view of the back of a ceiling panel assembly according to example embodiments.

Further, a perspective view of the back surface of a ceiling panel assembly 804 is shown in FIG. 12. The ceiling panel assembly 804 includes four ceiling panels 806 attached to five bows 812. Each bow 812 can be attached to two adjacent panels 806. The bows 812 are fixedly attached to the spine 814 which runs across all four ceiling panels 806 for the length of the ceiling panel assembly 804. Three arms 816 rotatably connect to the spine 814, where two are located at the respective edges of the ceiling panel assembly 804 and one is located near the middle. However, any number of arms 816 can be attached to the spine 814 to provide support depending on the weight and shape of the ceiling panel assembly 804. The ceiling panel assembly 804 is shown in a use position with the adjustable straps 818 engaged and includes two light fixtures on alternating panels 806. The adjustable straps 818 are attached to the ceiling panels 806 with separate brackets that include the corresponding attachment for latch 820. A plurality of ceiling panel assemblies 804 can be installed in series along the same batten and/or in front of each other on parallel battens. The ceiling panel assemblies 804 can be positioned at varying angles. For example, when installed on parallel battens, each row of ceiling panel assemblies 804 can be positioned at a different angle to better direct sound toward an audience. As discussed above, one or more rows of ceiling panel assemblies 804 can form an alternate ceiling, or a cloud, for a performance venue, with or without towers to complete an acoustic shell.

Figure 13:
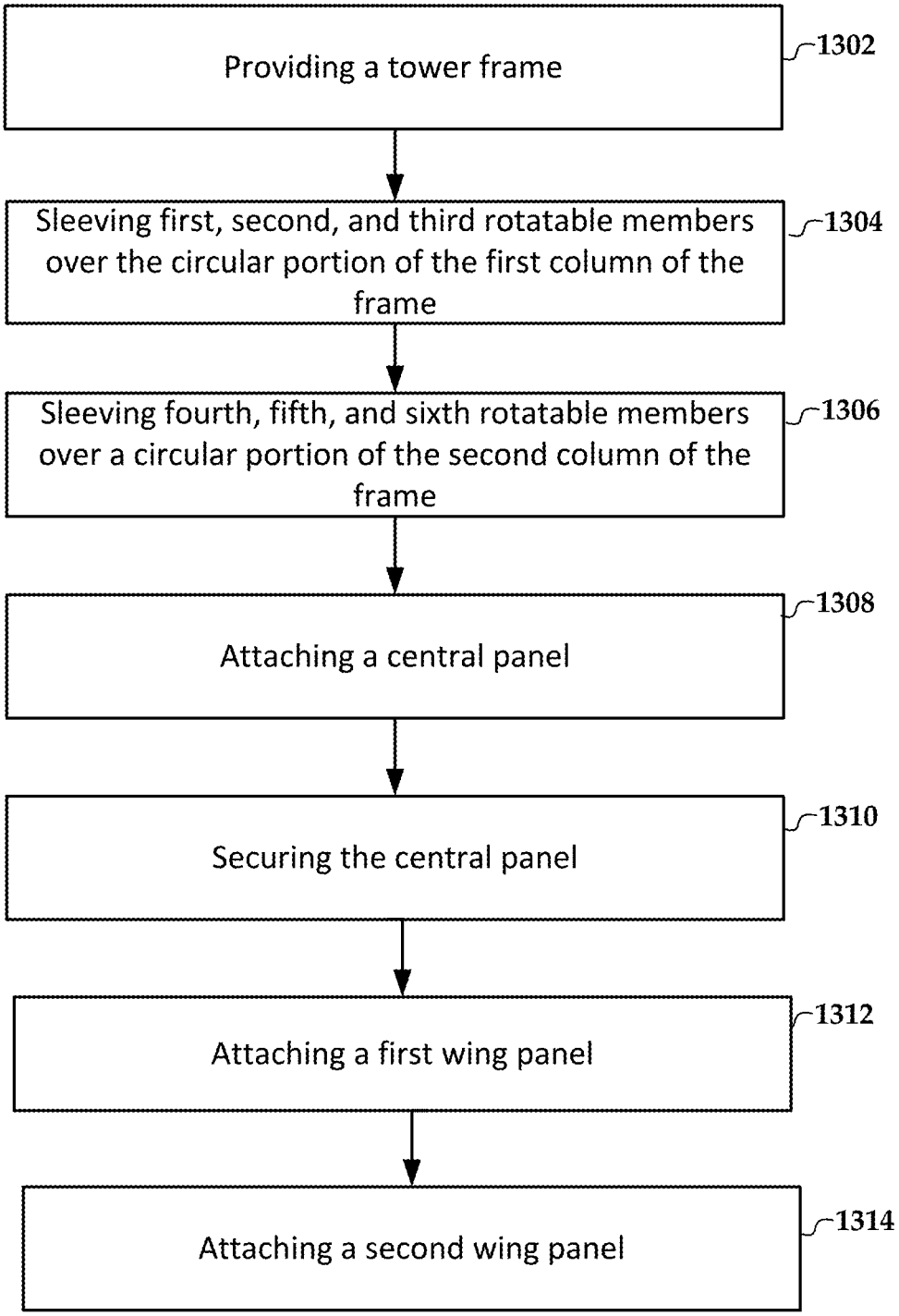
FIG. 13 is a method for assembling an acoustic shell tower according to example embodiments.

FIG. 13 illustrates a method for assembling an acoustic shell tower. While shown in a sequential order, several of the steps may be performed simultaneously or in an alternative order. First, a tower frame is provided 1302. The frame comprises a wheeled base and first and second columns attached to respective arms of the wheeled base at approximately ninety degree angles. Each column comprises a circular portion with a channel along the length of the column and a noncircular portion coupled to the first circular portion opposite the channel, e.g., with a web, and has at least one channel along the length of the column. First, second, and third rotatable members are sleeved over the circular portion of the first column 1304, wherein each rotatable member comprises a partial collar, the portion that is sleeved over the circular portion, and a tab. The tabs of the first and third members are positioned in a first direction away from the second column, and the tab of the second rotatable member is positioned in a second, opposing direction toward the second column. Similarly, fourth, fifth, and sixth rotatable members, each having a partial collar and a tab, are sleeved over a circular portion of the second column 1306. The tabs of the fourth and sixth members are positioned in the second direction away from the first column, and the tab of the fifth rotatable member is positioned in the first direction toward the first column. Each of the rotatable members on a column can be positioned adjacent each other, e.g., as close as possible but still allowing for rotation about the circular portion, or they can be positioned with a predetermined spacing between them.

The panels of the acoustic shell are attached to the tabs of the rotatable members. A central panel is attached to the tabs of the second and fifth rotatable members 1308. The back surface of the panel is attached using any variety of attachment methods such as bolts, screws, welding, adhesives, etc. The central panel is secured so as to be fixed in place by securing the second and fifth rotatable members to the respective first and second columns 1310. The rotatable members are secured to the columns by fixing, e.g., by bolting, the partial collar portion of the rotatable member to the channel in the circular portion of the column. This is performed for both sides of the central panel. Depending on the location of the rotatable members on the sides of the central panel, the rotatable members can be secured at the same height on the respective columns, or at varying heights. For example, if the rotatable members are attached to corresponding positions on either side of the central panel, the rotatable members would be secured at the same height on the respective columns (assuming a quadrangular shaped panel).

While the central panel is fixed in place, wing panels are attached to be rotatable with respect to the tower. A back surface of a first wing panel is attached to the tabs of the first and third rotatable members 1312. The first wing panel is configured to rotate about the first column, for example on the left side of the tower when viewed from the front. The first wing panel can be rotated to an open position substantially flush with the central panel and rotated in a rearward direction toward the base, or folded, to a storage position. Similarly, a back surface of a second wing panel is attached to the tabs of the fourth and sixth rotatable members 1314. The second wing panel is configured to rotate about the second column, for example on the right side of the tower when viewed from the front. The second wing panel can be rotated to an open position substantially flush with the central panel and rotated in a rearward direction toward the base, or folded, to a storage position. While the method describes attaching three panels to the tower, additional panels may be attached in a similar manner in vertical alignment with the three described panels. Additional wing panels can be fastened to wing panels above and/or below them to prevent individual panel rotation along the tower.

In addition, the tower frame can include a variety of components attached along the columns. The first and second columns each comprise a noncircular portion coupled to the circular portion opposite the channel of the circular portion, e.g., via a web portion. Each noncircular portion comprises at least one channel along the length of the respective first and second column. In further embodiments, the noncircular portion comprises a rectangular shape having a channel on three of the four sides along the length of the respective first and second columns and the fourth side of each noncircular portion is coupled to the respective first and second circular portions via a web. A cross-support can be coupled to the first and second columns via a channel of each of the noncircular portions. For example, the cross-support can be fixed, e.g., bolted, to a channel on the rear side, the side facing away from the panels, of each of the columns. Other components can include locking features for the wing panels, lighting, speakers, and additional support devices such as braces between the base and the columns.

Once the tower is assembled, the acoustic tower can be manually moved. For example, the tower can be manually moved among performance (use) locations such as on a stage and to a storage location. Moving the tower involves rotating the first and second wing panels away from the central panel to a folded position, and removing a portion of the bottom of the central panel. A wheeled transport is inserted into the space vacated by the removed portion of the central panel into a nested relationship with the base. The wheeled transport includes a bar with hooks on each end that correspond to a position on footing structures at the bottom of the first and second columns. The footing structures are engaged with the hooks in a locked position. The wheeled transport also includes a dual-lever system for manually lifting the footing structures off the support surface (e.g., ground, stage floor, etc.). A person can manipulate the dual-lever system such as by pushing down on an upper lever to elevate the first and second columns and their respective footing structures. Once elevated, the tower may be moved by moving the wheeled transport to a desired location (e.g., a storage location).

After depositing the tower at a storage location, the tower can be lowered to the support surface and the wheeled transport can be disengaged from the footing structures. This allows the wheeled transport to be used to repeat the process with any number of additional towers. When those additional towers are also moved to the storage location, they can be placed in a nesting relationship with previously stored towers. For example, the wheeled transport can be used to maneuver the base of a tower into a nesting relationship with a previously stored tower. This storage configuration can save space and provide a ready position for retrieval when one or more towers are needed for construction of another acoustic shell.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The foregoing description of the example embodiments has been presented for the purposes of illustration and description. It is not intended to be exhaustive or to limit the inventive concepts to the precise form disclosed. Many modifications and variations are possible in light of the above teaching. Any or all features of the disclosed embodiments can be applied individually or in any combination are not meant to be limiting, but purely illustrative. It is intended that the scope be limited not with this detailed description, but rather determined by the claims appended hereto.

That which is claimed is:

1. A system comprising:

a first column comprising a first circular portion with a channel along the length of the first column, the first circular portion configured to attach to one or more panels, and a first noncircular portion coupled to the first circular portion opposite the channel and having at least one channel along the length of the first column;

a second column comprising a second circular portion with a channel along the length of the second column, the second circular portion configured to attach to one or more panels, and a second noncircular portion coupled to the second circular portion opposite the channel of the second circular portion and having at least one channel along the length of the second column; and a base comprising first and second arms having first and second ends, wherein the first end of each arm is coupled to opposing ends of a cross-support and the second end of the first arm is coupled to the first column at about a ninety degree angle and the second end of the second arm is coupled to the second column at about a ninety degree angle, and the length of the cross-support is less than the distance between the first and second columns;

and two or more rotatable members comprising a partial collar and a tab, the two or more rotatable members sleeved onto the first and second circular portions, wherein the tab of a first rotatable member on the first column is positioned directed toward the second column and the tab of a second rotatable member on the second column is positioned directed toward the first column, a central panel is attached to the tabs of the first and second rotatable members and the first rotatable member is locked in position via the channel of the first circular portion and the second rotatable member is locked in position via the channel of the second circular portion.

2. The system of claim 1, wherein the first and second noncircular portions comprise a rectangular shape having a channel on three of the four sides along the length of the respective first and second column and the fourth side of each noncircular portion is coupled to the respective first and second circular portions via a web.

3. The system of claim 1, wherein a plurality of central panels are attached to the first and second columns in vertical alignment.

4. The system of claim 1, wherein a third and a fourth rotatable member are sleeved onto the first column, wherein the third rotatable member is below the first rotatable member and the fourth rotatable member is above the first rotatable member, the tabs of the third and fourth rotatable members are positioned directed away from the second column, and a first wing panel is attached to the tabs of the third and fourth rotatable members and configured to rotate about the first circular column, and a fifth and a sixth rotatable member are sleeved onto the second column, wherein the fifth rotatable member is below the second rotatable member and the sixth rotatable member is above the second rotatable member, the tabs of the fifth and sixth rotatable members are positioned directed away from the first column, and a second wing panel is attached to the tabs of the fifth and sixth rotatable members and configured to rotate about the second circular column.

5. The system of claim 4, wherein a plurality of wing panels are attached in vertical alignment to the first and second columns.

6. The system of claim 4, wherein the first and second wing panels rotate to a folded position proximate the respective first and second arms of the base.

7. The system of claim 1, wherein the first and second columns each comprise a first end proximate a support surface and a second, distal end opposing the first end, and the proximate end of the first and second columns include a footing structure, and the system is configured to be moved manually.

8. The system of claim 1, wherein one or more components are attached to at least one channel of the first and second noncircular portions.

9. The system of claim 4, wherein the first and second columns each comprise a first end proximate a support surface and a second, distal end opposing the first end, and the system further comprises at least one ceiling panel assembly proximate the distal ends of the first and second columns.

10. The system of claim 9, wherein the at least one ceiling panel assembly is rotatable between a storage position and one or more use positions.

11. A system comprising:

a first column comprising a first circular portion with a channel along the length of the first column, the first circular portion configured to attach to one or more panels, and a first noncircular portion coupled to the first circular portion opposite the channel and having at least one channel along the length of the first column;

a second column comprising a second circular portion with a channel along the length of the second column, the second circular portion configured to attach to one or more panels, and a second noncircular portion coupled to the second circular portion opposite the channel of the second circular portion and having at least one channel along the length of the second column;

a base comprising first and second arms having first and second ends, wherein the first end of each arm is coupled to opposing ends of a cross-support and the second end of the first arm is coupled to the first column at about a ninety degree angle and the second end of the second arm is coupled to the second column at about a ninety degree angle, and the length of the cross-support is less than the distance between the first and second columns;

at least one central panel having opposing front and back surfaces and opposing first and second sides, wherein a first rotatable member comprising a partial collar and a tab is sleeved over the first column with the tab directed toward the second column and a second rotatable member comprising a partial collar and a tab is sleeved over the second column with the tab directed toward the first column, and the tab of the first rotatable member is attached to the back surface on the first side of the at least one central panel and the tab of the second rotatable member is attached to the back surface on the second side of the at least one central panel, and the first rotatable member is locked in position via the channel of the first circular portion and the second rotatable member is locked in position via the channel of the second circular portion; and at least one wing panel having opposing front and back surfaces and opposing first and second sides, wherein a third and a fourth rotatable member are sleeved onto the first column and the third rotatable member is below the first rotatable member and the fourth rotatable member is above the first rotatable member, the tabs of the third and fourth rotatable members are positioned directed away from the second column and are attached to the back surface of the at least one wing panel on the first side and the at least one wing panel is configured to rotate about the first circular column.

12. The system of claim 11, further comprising:

a second wing panel having opposing front and back surfaces and opposing first and second sides, wherein a fifth and a sixth rotatable member are sleeved onto the second column and the fifth rotatable member is below the second rotatable member and the sixth rotatable member is above the second rotatable member, the tabs of the fifth and sixth rotatable members are positioned directed away from the first column and are attached to the back surface of the second wing panel on the first side and the second wing panel is configured to rotate about the second circular column.

13. The system of claim 11, wherein the first and second noncircular portions comprise a rectangular shape having a channel on three of the four sides along the length of the respective first and second column and the fourth side of each noncircular portion is coupled to the respective first and second circular portions via a web.

14. The system of claim 11, wherein the first and second columns each comprise a first end proximate a support surface and a second, distal end opposing the first end, and the proximate end of the first and second columns include a footing structure, and the system is configured to be moved manually.

15. The system of claim 11, wherein one or more components are attached to at least one channel of the first and second noncircular portions.

16. A method comprising:

providing a tower frame comprising a wheeled base and first and second columns attached to respective arms of the wheeled base at approximately ninety degree angles, each column comprising a circular portion with a channel along the length of the column and a noncircular portion coupled to the first circular portion opposite the channel and having at least one channel along the length of the column;

sleeving first, second, and third rotatable members over the circular portion of the first column, wherein each rotatable member comprises a partial collar and a tab and the tabs of the first and third members are positioned in a first direction away from the second column, and the tab of the second rotatable member is positioned in a second, opposing direction toward the second column;

sleeving fourth, fifth, and sixth rotatable members over a circular portion of the second column, wherein each rotatable member comprises a partial collar and a tab and the tabs of the fourth and sixth members are positioned in the second direction away from the first column and the tab of the fifth rotatable member is positioned in the first direction toward the first column;

attaching a back surface of a central panel having a top and a bottom, the bottom being proximate a support surface, to the tabs of the second and fifth rotatable members;

securing the second and fifth rotatable members to the respective first and second columns via respective channels along the circular portions of the first and second columns;

attaching a back surface of a first wing panel to the tabs of the first and third rotatable members, the first wing panel configured to rotate about the first column; and attaching a back surface of a second wing panel to the tabs of the fourth and sixth rotatable members, the second wing panel configured to rotate about the second column.

17. The method of claim 16, wherein the first and second columns each comprise a noncircular portion coupled to the circular portion opposite the channel of the circular portion, each noncircular portion comprising at least one channel along the length of the respective first and second column, and a cross-support is coupled to the first and second columns via the respective at least one channel of the noncircular portions.

18. The method of claim 16, further comprising:

rotating the first and second wing panels away from the central panel to a folded position;

removing a portion of the bottom of the central panel;

inserting a wheeled transport under the central panel and into a nested relationship with the base;

engaging footing structures positioned at the respective ends of the first and second columns proximate the support surface with the wheeled transport;

manually lifting the footing structures off the support surface with the wheeled transport; and moving the wheeled transport and frame comprising the panels to a second location.

19. The method of claim 18, wherein the method is repeated for a plurality of towers and the plurality of towers is stored at the second location with the respective bases in a nested configuration.

* * * * *